US009567041B2

(12) United States Patent
Millheim

(10) Patent No.: US 9,567,041 B2
(45) Date of Patent: Feb. 14, 2017

(54) DOCKING AND DRILLING STATIONS FOR RUNNING SELF-STANDING RISERS AND CONDUCTING DRILLING, PRODUCTION AND STORAGE OPERATIONS

(71) Applicant: Keith K. Millheim, The Woodlands, TX (US)

(72) Inventor: Keith K. Millheim, The Woodlands, TX (US)

( * ) Notice: Subject to any disclaimer, the term of this patent is extended or adjusted under 35 U.S.C. 154(b) by 0 days.

(21) Appl. No.: 14/959,862

(22) Filed: Dec. 4, 2015

(65) Prior Publication Data

US 2016/0090156 A1 Mar. 31, 2016

Related U.S. Application Data

(63) Continuation of application No. 14/261,167, filed on Apr. 24, 2014, now abandoned, which is a continuation of application No. 13/727,241, filed on Dec. 26, 2012, now abandoned, which is a continuation of application No. 13/205,119, filed on Aug. 8, 2011, now abandoned, which is a continuation of application No. 12/982,408, filed on Dec. 30, 2010, now abandoned, which is a continuation of application No. 12/274,192, filed on Nov. 19, 2008, now abandoned.

(60) Provisional application No. 61/003,657, filed on Nov. 19, 2007.

(51) Int. Cl.

| | |
|---|---|
| ***B63B 35/44*** | (2006.01) |
| ***B63B 21/50*** | (2006.01) |
| ***E21B 43/013*** | (2006.01) |
| *B63B 21/00* | (2006.01) |

(52) U.S. Cl.

CPC ..... *B63B 21/508* (2013.01); *B63B 21/00* (2013.01); *B63B 21/507* (2013.01); *B63B 35/44* (2013.01); *B63B 35/4413* (2013.01); *E21B 43/013* (2013.01); *B63B 2021/003* (2013.01); *B63B 2035/448* (2013.01)

(58) Field of Classification Search

CPC .... B63B 35/4413; B63B 21/508; B63B 35/44; B63B 21/507; B63B 2021/003; B63B 2035/448

USPC ..... 114/264–267

See application file for complete search history.

(56) References Cited

U.S. PATENT DOCUMENTS

| | | | |
|---|---|---|---|
| 5,342,148 | A | 8/1994 | Huete et al. |
| 6,336,419 | B1 | 1/2002 | Breivik |
| 6,494,271 | B2 | 12/2002 | Wilson |

(Continued)

FOREIGN PATENT DOCUMENTS

| | | |
|---|---|---|
| WO | 2006068497 | 6/2006 |

*Primary Examiner* — Daniel V Venne

(74) *Attorney, Agent, or Firm* — Andrus Intellectual Property Law, LLP

(57) ABSTRACT

A sea vessel exploration and production system is provided, wherein the system includes a drilling station formed from at least one section of a first sea vessel hull; and a docking station, which is also formed from at least one section of a second sea vessel hull. A mooring system suitable for connecting the drilling station to the docking station is also provided. Means for anchoring the vessels to the seafloor, and for attaching them to turret buoys, are also considered. Various exploration and production packages, as well as equipment required to deploy and control a self-standing riser system in either deep or shallow waters, are also described.

16 Claims, 8 Drawing Sheets

(56) References Cited

U.S. PATENT DOCUMENTS

| | | | | |
|---|---|---|---|---|
| 7,934,560 | B2 | 5/2011 | Roveri et al. | |
| 8,225,735 | B1 * | 7/2012 | Galway | B63B 21/58 114/242 |
| 8,991,447 | B1 * | 3/2015 | Petersen | B67D 7/42 114/256 |
| 2007/0000419 | A1 | 1/2007 | Millheim et al. | |

* cited by examiner

DOCKING AND DRILLING STATIONS FOR RUNNING SELF-STANDING RISERS AND CONDUCTING DRILLING, PRODUCTION AND STORAGE OPERATIONS

CROSS REFERENCE TO RELATED APPLICATIONS

This application is a divisional of U.S. patent application Ser. No. 14/261,167 filed Apr. 24, 2014 which application is a continuation of U.S. patent application Ser. No. 13/727,241 filed Dec. 26, 2012, now abandoned, which application is a continuation of U.S. patent application Ser. No. 13/205,119 filed Aug. 8, 2011, now abandoned, which application is a continuation of U.S. patent application Ser. No. 12/982,408 filed Dec. 30, 2010, now abandoned, which application is a continuation of U.S. patent application Ser. No. 12/274,192 filed Nov. 19, 2008, now abandoned, which application claims priority of U.S. Provisional Application No. 61/003,657 filed Nov. 19, 2007. Each of the above identified applications is incorporated herein by reference.

FIELD OF THE INVENTION

The present invention relates generally to offshore facilities used in connection with the exploration and production of oil and gas, and in a particular though non-limiting embodiment, to a docking and drilling vessel system suitable for deploying self-standing risers and conducting oil and gas drilling, production and storage operations.

BACKGROUND OF THE INVENTION

Offshore drilling is quickly becoming the prevalent method of exploring and producing oil and gas, especially in Western countries where land operations are frequently inhibited by environmental concerns. There is, however, a serious shortfall of offshore drilling units called Mobile Offshore Drilling Units, or MODUs. The relative unavailability of MODUs has resulted in significant delays in many drilling projects. Consequently, the cost of obtaining either a new or existing MODU for an exploration and production operation has dramatically increased over the past decade.

As will be readily appreciated by those of skill in the art, MODUs are utilized during the early testing phase required to evaluate oil, gas, and other hydrocarbon discoveries. However, due to the lack of floating production facilities and the high cost of MODUs, early testing is seldom accomplished, which often results in unnecessary delays and inaccurate predictions of economic assessments, project development schedules, etc. Moreover, procurement of offshore production and storage facilities required to operate offshore projects in a timely manner can be quite difficult. In extreme circumstances or in especially remote regions, the lag time between hydrocarbon discovery and the production phase can reach 10 years or more.

Meanwhile, self-standing riser assemblies supported by buoy devices are becoming a more common method of performing oil and gas exploration and production related activities. Compared to the large scale riser assemblies typically serviced by MODUs, the self-standing riser provides for lighter and less expensive riser tubulars (e.g., drilling pipe, stack casing, etc.). Self-standing risers also admit to the use of lighter blowout preventers, such as those used by land drilling rigs.

Moreover, the top buoy of a self-standing riser system can be positioned near the surface of the water in which it is disposed (for example, less than around 100 ft. below surface level), allowing for efficient drilling in even shallow waters. Furthermore, where riser systems are tensioned and controlled with associated buoyancy chambers, buoy-based systems can be used successfully in much deeper waters.

However, as those of skill in the art have learned in the field, buoy-based systems utilizing general purpose vessels for riser and buoyancy chamber deployment are deficient in that large-scale operations (e.g., deployment in very deep or turbulent waters, or projects involving multiple combinations of riser strings and buoyancy chambers, etc.) are very difficult to control, and thus installation, operation and maintenance of the resulting system is significantly impaired.

There is, therefore, a need for a custom vessel that admits to efficient deployment of large-scale riser systems in a manner similar to the manner of a MODU even when a MODU is not available.

SUMMARY OF THE INVENTION

A sea vessel exploration and production system is provided, wherein the system includes a drilling station formed from at least one section of a first sea vessel hull; and a docking station, which is also formed from at least one section of a second sea vessel hull. A mooring system suitable for connecting the drilling station to the docking station is also provided. Means for anchoring the vessels to the seafloor, and for attaching them to turret buoys, are also considered. Various exploration and production packages, as well as equipment required to deploy and control a self-standing riser system in either deep or shallow waters, are also described. Also, described is a method for providing a sea vessel exploration and production system used with a sub-sea well.

DETAILED DESCRIPTION

The description that follows includes exemplary systems, methods, and techniques that embody various aspects of the presently inventive subject matter. However, it will be readily understood by those of skill in the art that the disclosed embodiments may be practiced without one or more of these specific details. In other instances, well-known manufacturing equipment, protocols, structures and techniques have not been shown in detail in order to avoid obfuscation in the description.

Figure 1A:
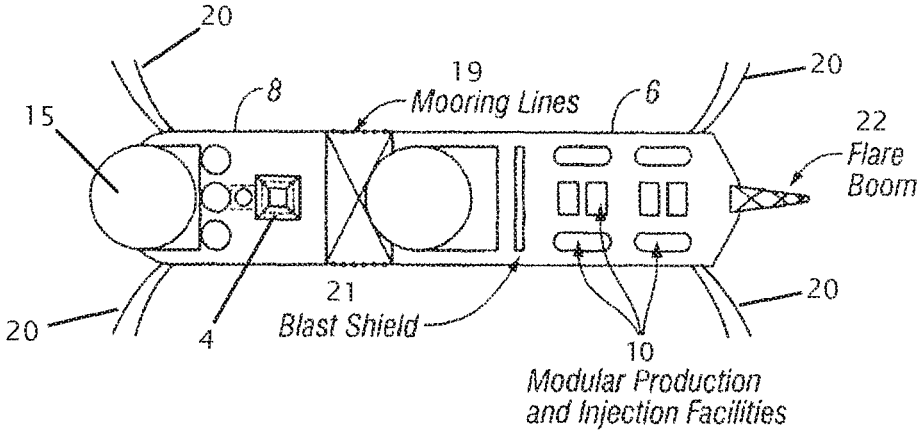
FIG. 1A is an overhead view of a docking and drilling station moored end-to-end, according to example embodiments.
Figure 1B:
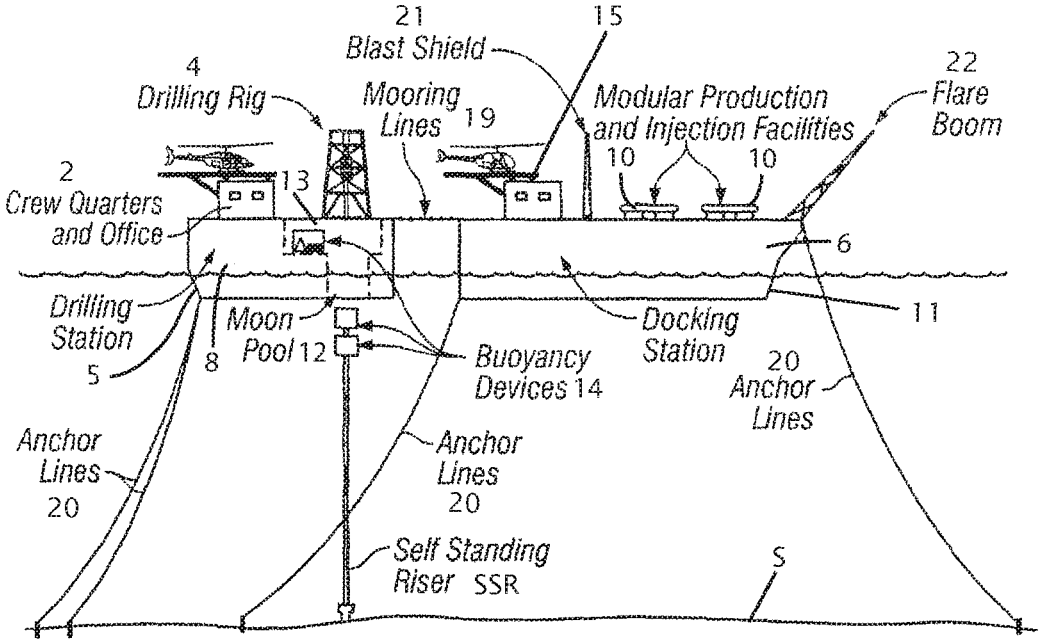
FIG. 1B is a side view of a docking and drilling station moored end-to-end, according to example embodiments.

Referring now to the example embodiment illustrated in FIG. 1A, an overhead view of a docking station 6 and a drilling station 8 are depicted as being moored together in an end-to-end manner. The embodiment of the drilling station 8 shown in FIG. 1B comprises crew quarters and an operations office 2; a drilling rig 4; a hull 5; a void space 13 designed for housing and deploying various buoyancy devices 14; a helipad 15; a moon pool 12; a plurality of anchor or mooring lines 20 used to anchor the system to an associated seabed S; and a mooring system defined by mooring or docking lines 19 configured to moor drilling station 8 and docking station 6 together. The example embodiment of the docking station 6 further comprises modular production, testing and injection facilities 10; a hull 11; a plurality of anchor lines 20; and mooring lines 19 configured to mate with the mooring assembly of the drilling station 8. A self-standing riser SSR disposed in mechanical communication with one or more buoyancy devices 14 is also provided. A blast shield 21 is positioned on the docking station 6 between the helipad 15 and the facilities 10.

In the embodiment depicted in FIG. 1A, the docking station 6 and drilling station 8 are moored together using mooring lines 19 in such a manner that both portions of the combined vessel are able to properly perform offshore drilling operations. In alternative embodiments, various other devices can be used to secure the mooring system, for example, clamps, rods, latches, locks and other mechanical devices; strong magnets and electrical control systems; vacuum systems, etc.

Typical embodiments of the docking and drilling stations further comprise a plurality of oil and gas related drilling, production and exploration equipment. For example, a modified land or platform drilling rig 4 installed on the drilling station 8 can be used to operate a self standing riser SSR while maintaining functional stability and efficient operational continuity. Similar equipment disposed within or upon the drilling station 8 enables storage, deployment, lifting, and retrieval operations, as well as storage of additional risers, such as stress joints 16, and one more buoyancy devices 14 should they be required during drilling operations.

In further embodiments, hydrocarbons such as oil, gas, liquid natural gas, etc., encountered during the drilling process are separated, treated and stored either onboard or within docking station 6. In still further embodiments, docking station 6 further comprises modular production facilities 10 and storage space that can be used for testing operations or as a facility to separate oil, gas, water, etc. Other embodiments of the docking station 6 comprise one or more of a flare boom 22 used to bleed off gas and fluid pressure; oil, water and gas separators; and storage facilities used to store crude and previously treated oil and gas. In further embodiments still, water and gas injection equipment used to re-inject wells and the mechanical equipment required to facilitate such operations are also included.

Since the drilling station 8 does not necessarily have to support deployment of conventional riser and buoyancy chamber systems, it can utilize a typical land or platform drilling rig 4 modified to endure extreme sea and weather conditions. The embodiment depicted in FIG. 2, for example, illustrates an anchored drilling station 8 and docking station 6 operating in tandem to support and control a self-standing riser SSR system equipped with an associated buoyancy device 14. The drilling station of FIG. 2 further comprises a void space 13 suitable for the storage and handling of buoyancy devices 14, as well as a hoisting system 3 and retractable guide rails 26 that assist in guiding the buoyancy devices 14 below the hull 5 of drilling station 8.

Figure 2:
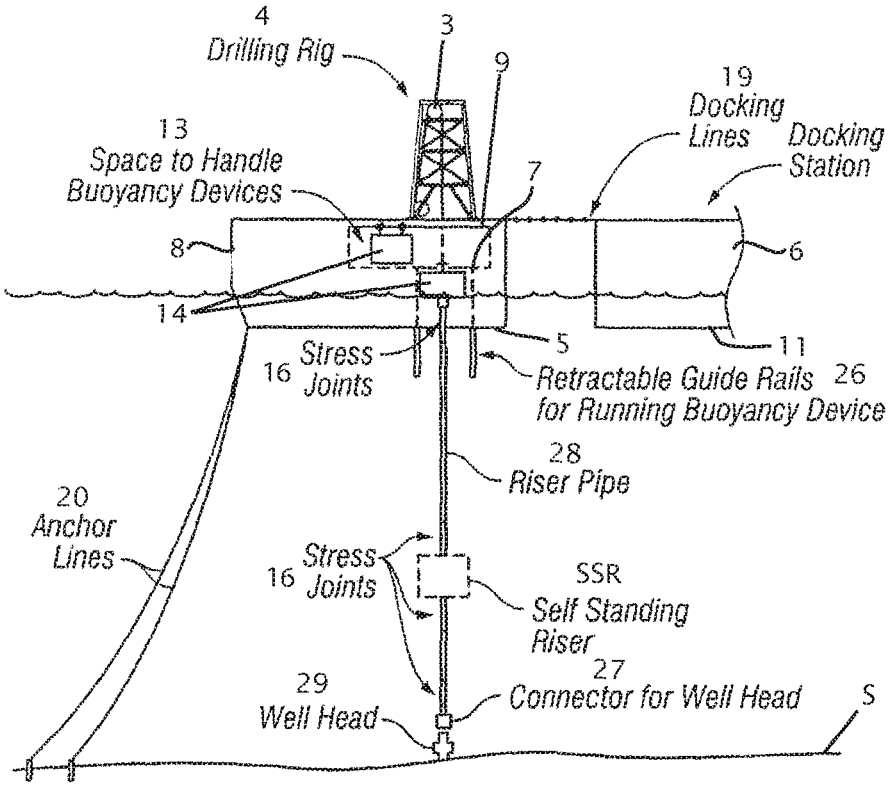
FIG. 2 is a schematic diagram of an anchored drilling station and docking station operating a self-standing riser assembly, according to example embodiments.

In various other embodiments, the drilling station 8 depicted in FIG. 2 allows the drilling rig 4 to hoist, lower and otherwise handle self standing riser SSR having a wellhead connector 27 and a riser pipe 28, casing, drilling pipe, etc., passed through the moon pool 12. One specific example embodiment permits self standing riser tubulars to be lowered into the water until a desired length is obtained and the required quantity of buoyancy devices 14 are in place. Although not depicted, those of skill in the art will appreciate that further embodiments of the drilling station 8 are equipped to deploy, store and handle most other types of routine or custom fit offshore drilling equipment, such as shear rams, ball valves, blowout preventers and hoists therefor.

Following installation of the self standing riser SSR, the drilling station 8 can commence drilling, completion, testing and workover operations, etc. As operations continue, some portions of the system can be removed so that the drilling station 8 can be utilized in other types of operations. In further embodiments, the drilling station 8 is utilized to drill a hole in a seabed S so as to permit installation of a wellhead 29 and associated casing. In still further embodiments, the drilling station 8 is used to remove and store the riser assemblies, such as stress joints 16, as well as attendant buoyancy devices 14 and other offshore drilling equipment.

In some example embodiments, the described installation and removal process is applied to wellheads 29 created by others and abandoned. Such projects would typically utilize cranes, hoists, winches, etc., operating in mechanical communication with the drilling station in order to perform installation and removal of existing riser assemblies, wellheads 29, production trees and blowout preventers.

In some embodiments, the void space 13 formed to store and handle buoyancy devices 14 further comprises a moveable floor 7, tracks, a gantry 9, etc., that transports buoyancy devices 14 to a desired location (e.g., near the moon pool 12) to be joined with a self standing riser assembly stack. Various embodiments of the moon pool 12 further comprise retractable guide rails 26 that assist in guiding and delivering the buoyancy devices 14 down below the hull 5 to a deployment station.

End-to-End and Side-to-Side Mooring of the Docking and Drilling Stations

Figure 3:
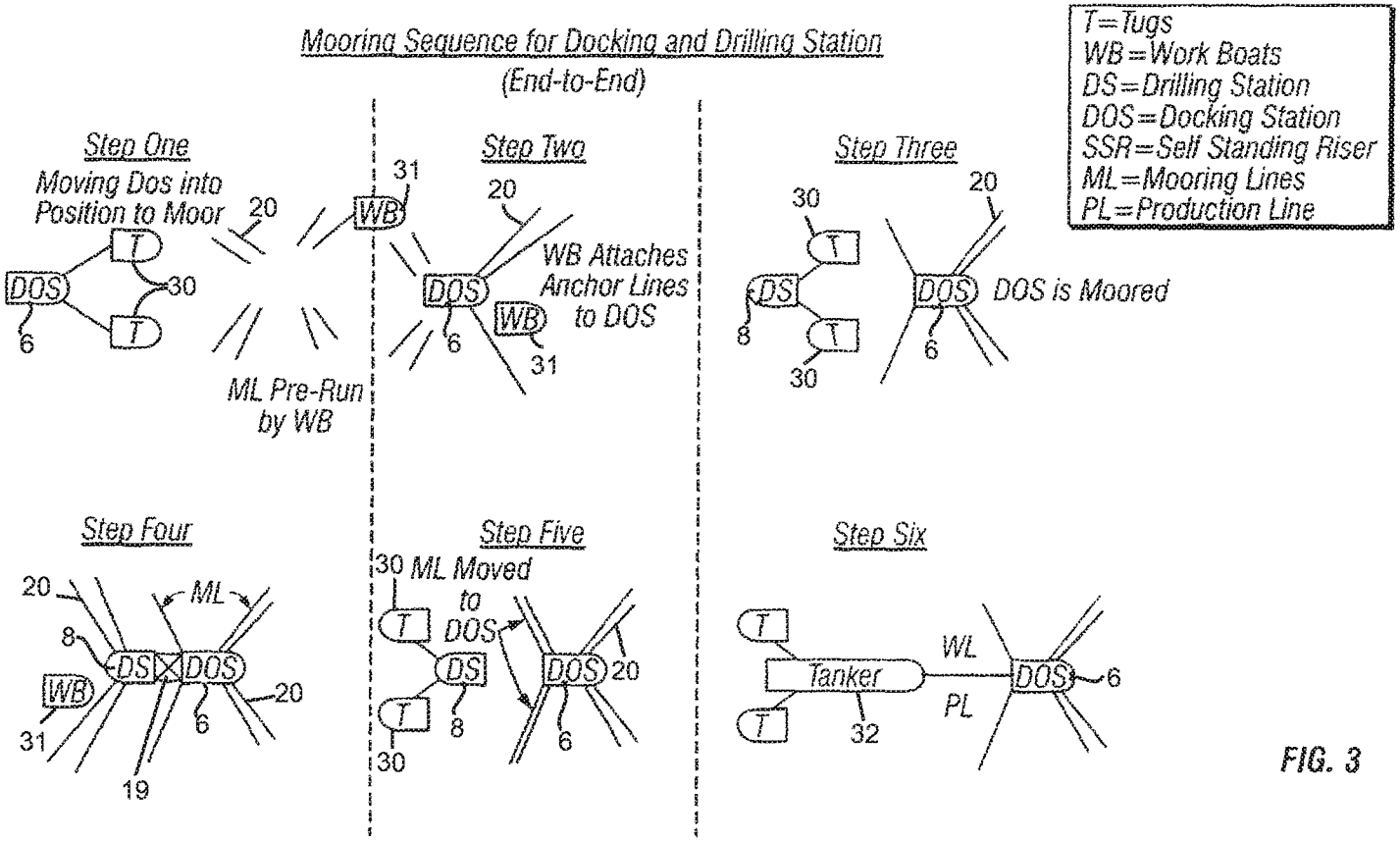
FIG. 3 illustrates a sequence of steps for mooring a docking station and a drilling station using an end-to-end method, according to example embodiments.
Figure 4:
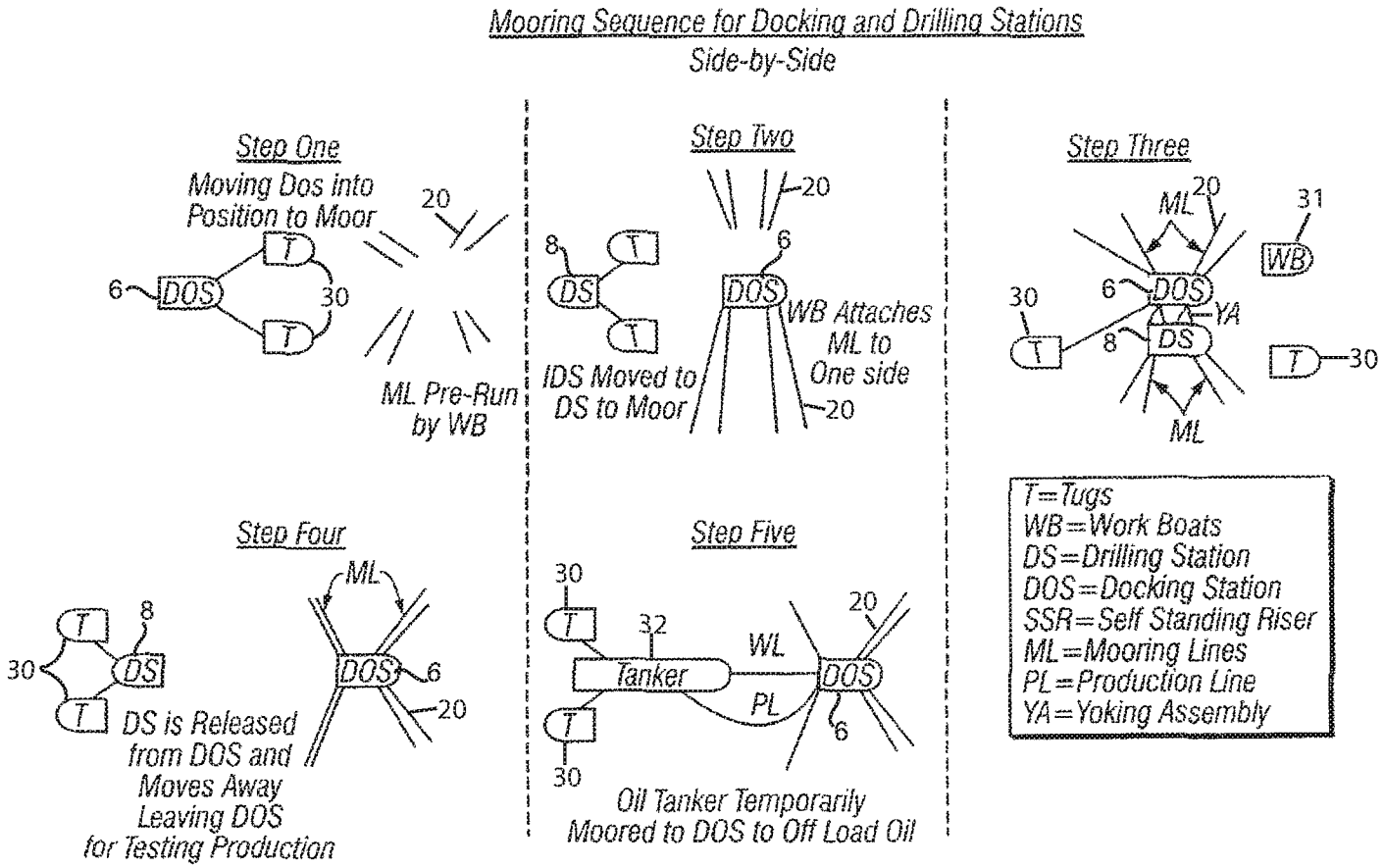
FIG. 4 illustrates a sequence of steps for mooring a docking station and a drilling station using a side-by-side method, according to example embodiments.

FIGS. 3 and 4 depict an embodiment of the docking station 6 and the drilling station 8 moored together using end-to-end and side-to-side mooring methods, respectively. In the example embodiment illustrated in Step 1 of both FIGS. 3 and 4, docking station 6 is towed by a towing vessel 30 toward anchor lines 20 preinstalled by workboats 31, anchor handling vessels, etc. Towing of the docking and drilling stations can of course be facilitated by any vessel 30 capable of towing another vessel of appropriate size, such as a work boat, a tug, etc.

Step 2 of FIG. 3 depicts various transportation vessels (e.g., workboats 31, towing vessels, etc.) transporting a plurality of anchor lines 20 to fastening members disposed in communication with the docking station 6. Some embodiments of the fastening members assist in adding tension to the anchor lines 20, and slowly moving the docking station 6 toward desired site coordinates.

In the end-to-end embodiment shown in FIG. 3, the anchor lines 20 are affixed to fastening members positioned on all sides of the docking station 6. Note, however, that the anchor lines 20 would typically be affixed to fastening members on a particular side of the docking station 6 in the side-to-side method depicted in Step 2 of FIG. 4. Such embodiments of side-to-side mooring help maintain proper lateral spacing and controlled efficient movement as the drilling station 8 and docking station 6 are joined. In further embodiments, the drilling station 8 is transported to within a close proximity of the docking station 6 during Step 2 of FIG. 4 and Step 3 of FIG. 3, and a plurality of anchor lines 20 are thereafter affixed to fastening members of the drilling station 8 in order to secure the system in a desired dynamic equilibrium.

Step 3 of FIG. 4 and Step 4 of FIG. 3 illustrate the drilling station 8 as disposed in stable operative communication with the docking station 6. Various known attachment means, such as mooring lines, as well as any new or custom designed fasteners or the like can be used to facilitate stable and reliable operations. In the embodiment depicted in FIG. 3, the drilling station 8 and the docking station 6 are mutually joined by mooring lines 19 and operated in a back-to-back or end-to-end manner, whereas in the embodiment illustrated in FIG. 4, the drilling station 8 and the docking station 6 are joined by a yoking assembly YA in a side-to-side manner. Either manner will, if configured correctly, permit the drilling station 8 to drill, deploy casing, deploy self standing riser tubulars, etc. In some embodiments, the drilling station 8 is configured to position itself over an existing self standing riser system in order to perform workover operations, well completions, and other common drilling operations.

In the embodiment illustrated in Steps 5 and 4 of FIGS. 3 and 4, respectively, the drilling station 8 is disconnected from the docking station 6 and towed away. In a typical example embodiment, anchoring lines 20 previously used to anchor the drilling station 8 in place are attached to the remaining docking station 6, thereby resulting in a spread mooring configuration suitable for receiving a new vessel. In some embodiments, the docking station 6 is then used as a testing or production vessel to process and separate oil, gas and water, etc. In further embodiments, the docking station 6 provide facilities to inject water and gas back into well(s), power to operate electric submersible pumps, or lifting support to aid with other production methods.

Step 5 of FIG. 4 and Step 6 of FIG. 3 depict an embodiment of the mooring sequence in which an oil tanker 32 is joined in communication with the docking station 6. As previously discussed, example embodiments may comprise a wide variety of attachment methods and means, such as mooring, docking, fastening, etc. In one example embodiment, the docking station 6 then utilizes pipes, tubulars, hoses, etc., to transfer oil, gas or other stored fluids to and from the tanker 32.

End-to-End Mooring Using a Turret Buoy

Figure 5:
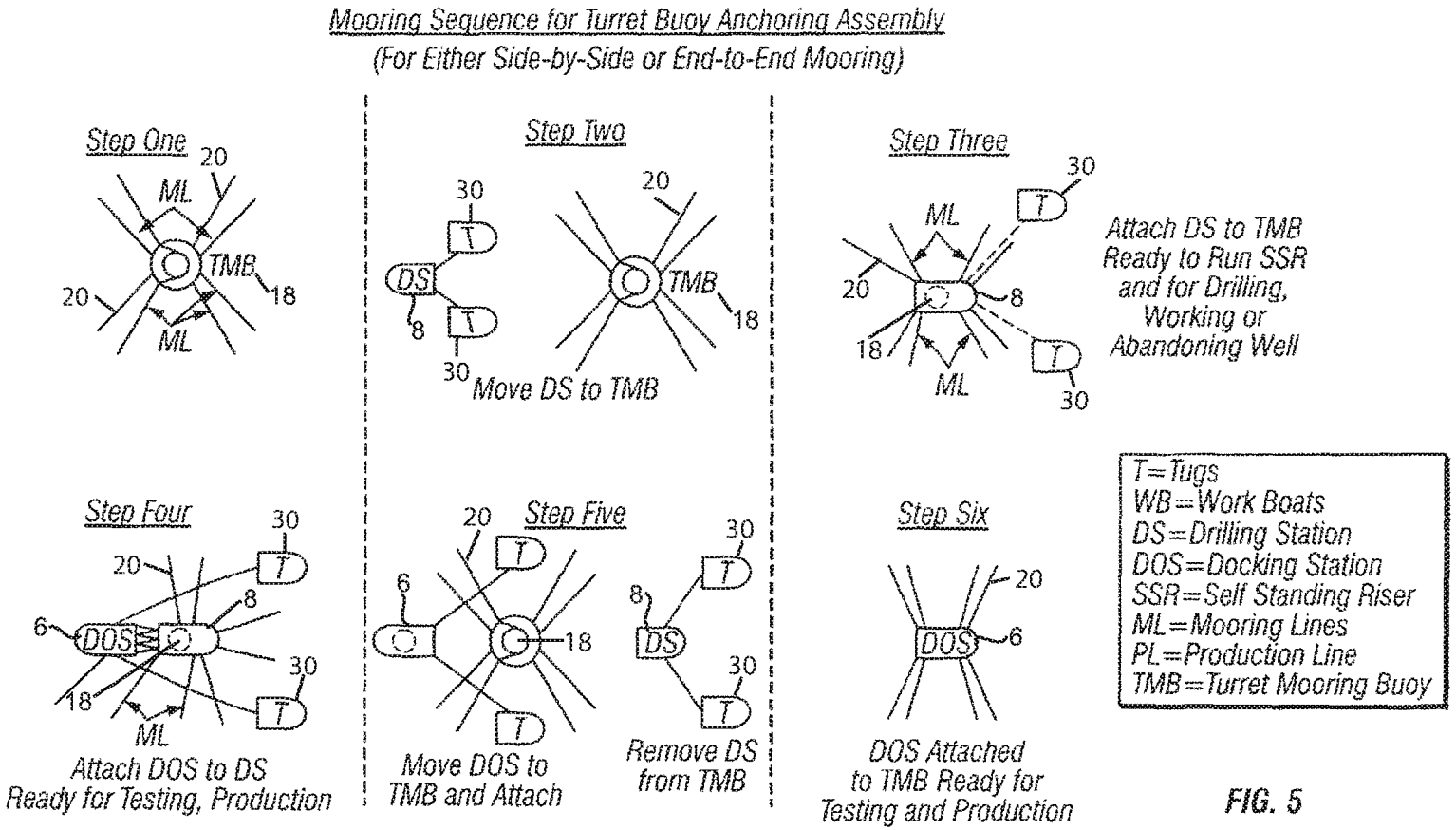
FIG. 5 illustrates a sequence of steps for mooring a docking station and a drilling station to a turret buoy anchoring assembly, according to example embodiments.

FIG. 5 depicts an embodiment of a turret mooring buoy 18 that allows the drilling station 8 and the docking station 6 to cooperate in a synchronized manner even in very poor weather conditions, such as strong winds, rough currents, etc. In the embodiment illustrated in Step 1 of FIG. 5, conventional mooring lines and anchor lines 20 are affixed to a turret mooring buoy 18 as known in the art. Embodiments of the drilling station 8 are subsequently towed to the turret mooring buoy 18, as illustrated in Step 2. In the embodiment depicted in Step 3, a plurality of towing vessels 30 position the drilling station 8 in relatively close proximity to the turret mooring buoy 18, where the drilling station 8 and the turret mooring buoy 18 are mutually joined. In Steps 4 and 5, the docking station 6 is similarly joined to the system in accord with the principles previously discussed above. In one specific embodiment, the drilling station 8 is also capable of performing a multitude of other offshore drilling functions, including deployment and operation of drilling equipment; the drilling of holes on the seabed and installation of casing; deployment and operation of self-standing riser, etc.

In the embodiments illustrated in Step 5 and Step 6, the docking station 6 is moved to a location and attached in communication with turret mooring buoy 18 after completion of operations by the drilling station 8. In further embodiments, the drilling station 8 is then removed from turret mooring buoy 18 to allow for attachment of the docking station 6 so that testing and production can commence.

Side-by-Side Mooring Using a Spread Mooring System

Figure 6:
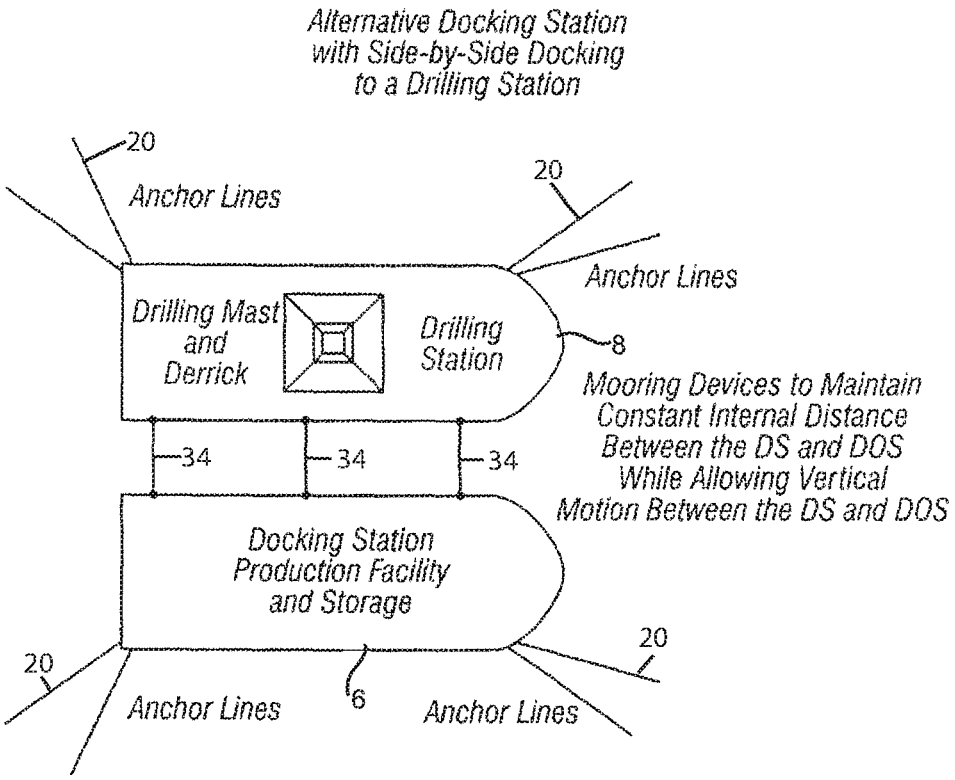
FIG. 6 is a schematic diagram of an alternative docking station with side-by-side docking to a docking station, according to example embodiments.

Referring now to the example embodiment depicted in FIG. 6, the docking station 6 and drilling station 8 are joined using a side-by-side mooring system. Various embodiments of the drilling station 8 are affixed to the docking station 6 using a system of attachment mechanisms 34, such as mooring, docking, fastening devices, etc., which lend support and provide rigid separation in the lateral direction while still allowing mutual vertical movement. In one embodiment, conventional mooring with anchor lines 20 can secure the drilling station 8 and docking station 6 in proximity of a self-standing riser SSR.

Several embodiments of side-by-side mooring utilize hydraulically compensated cylinders to maintain constant lateral distance and compensate for wave and swell actions. For example, embodiments using a hydraulically compensated cylinder can maintain separation forces while dampening related transient forces caused by wave and swell movement.

Figure 7:
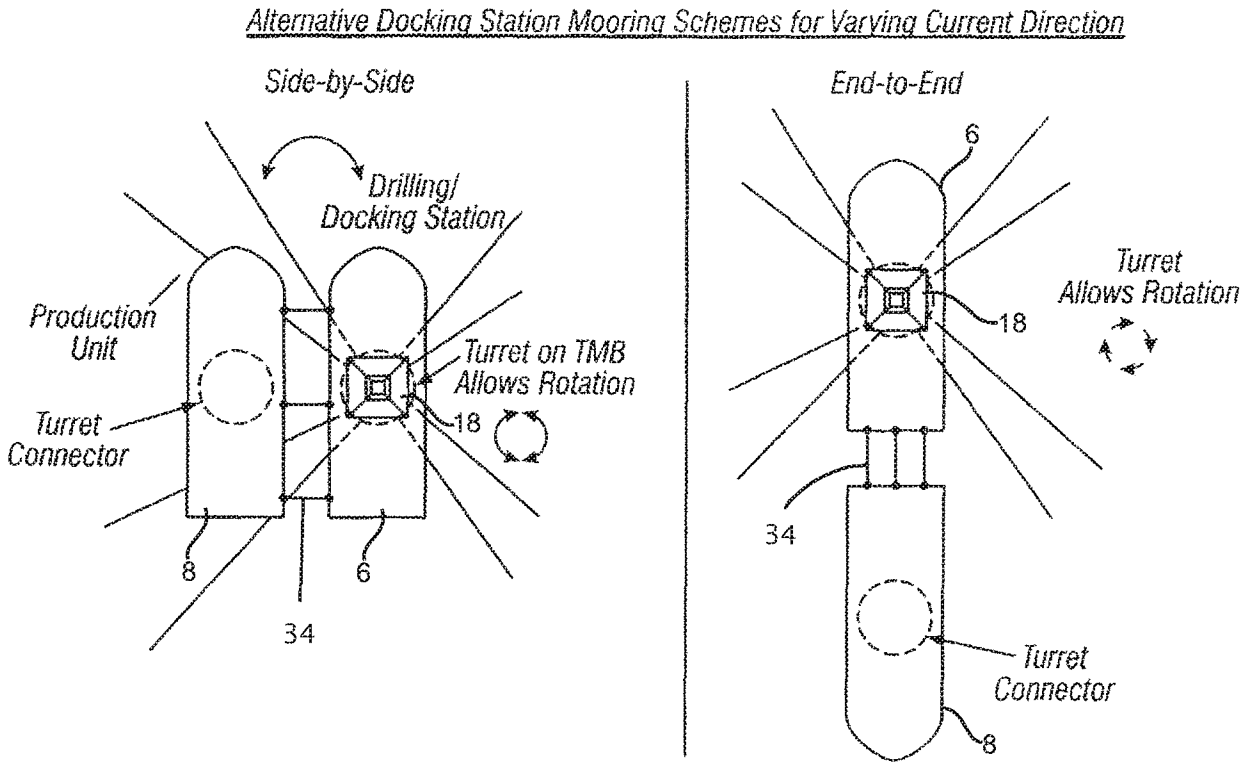
FIG. 7 is a schematic diagram of alternative docking station mooring schemes for varying current conditions, according to example embodiments.

End-to-End and Side-by-Side Mooring of the Drilling Station and Docking Station Using the Turret Moored Buoy Referring now to the example embodiment in FIG. 7, side-by-side and end-to-end mooring configurations of the drilling station 8 and docking station 6 attached in communication with a turret mooring buoy 18 is illustrated. In some embodiments, the turret buoy 18 is utilized for situations where a particular area of the water has significantly varying or conflicting currents. In further embodiments, turret mooring buoy 18 is designed to be attached to a self-standing riser SSR, while relative positioning of the drilling station 8 and docking station 6 is maintained. According to still further embodiments, the design of the turret mooring buoy 18 varies depending on the dimensions of the docking or drilling stations, or in conformity with the dimensions of the moon pool 12.

In some embodiments, the drilling station 8 and the docking station 8 attach to the turret mooring buoy 18 using mechanical or hydraulic couplers or other fastening devices known in the art. In the embodiment illustrated in FIG. 8, the turret mooring buoy 18 allows for a 360 degree rotation of the particular station with which it is disposed. For example, the docking station 6 can rotate 360 degrees once it is attached to the turret mooring buoy 18.

Figure 8:
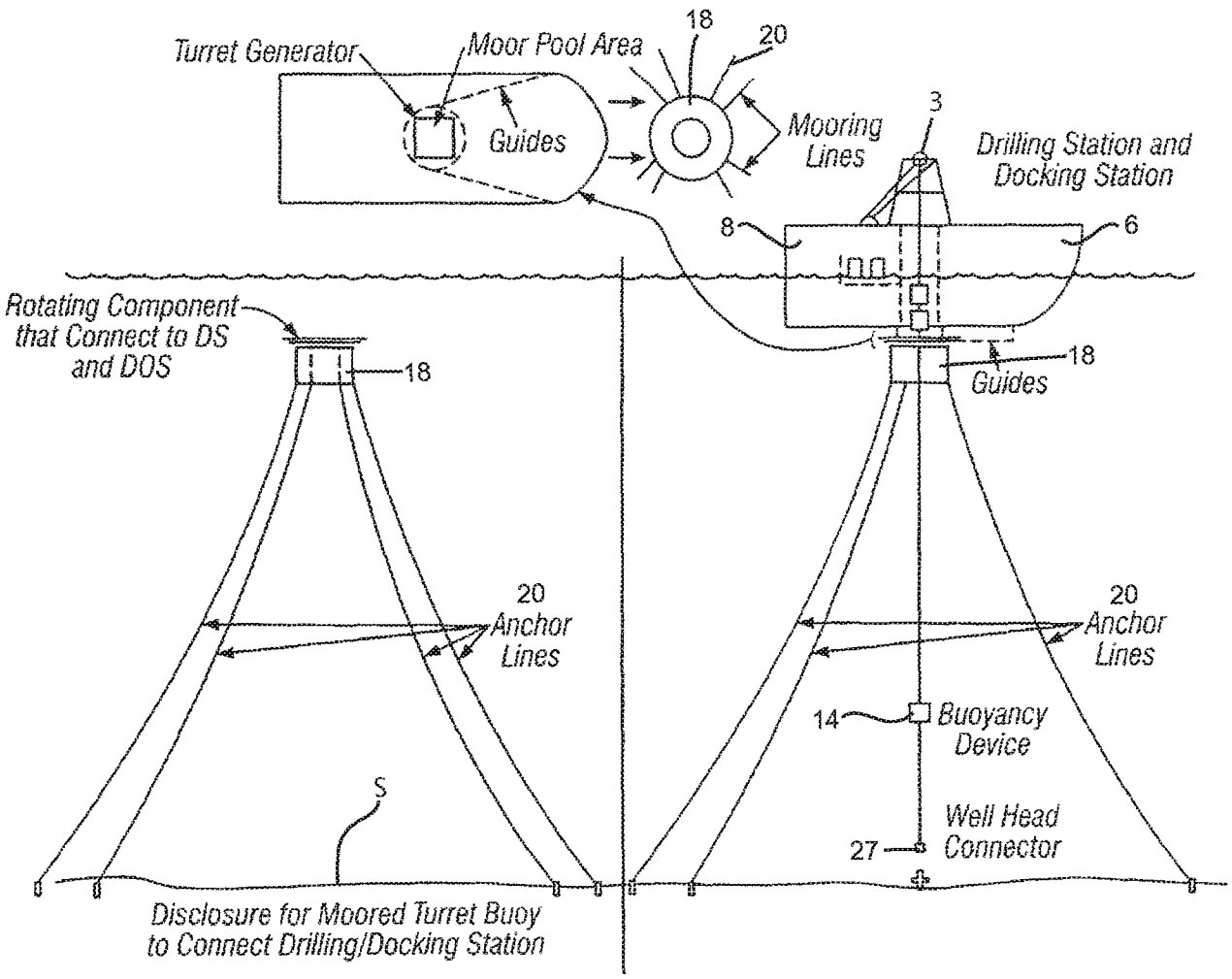
FIG. 8 is a schematic diagram of a docking station or a drilling station attached to a turret buoy, according to example embodiments.

In some example embodiments utilizing a turret mooring buoy 18, the drilling station 8 is moored first, and used to perform one or more of drilling, deployment, workover, completion, testing, etc., operations. In other embodiments, the docking station 6 is moored to the drilling station 8, and used to conduct one or more of the aforementioned operations, as depicted in FIG. 8. Once the work of drilling station 8 is concluded, it is detached from the turret buoy 18 while the docking station 6 remains behind for continued operations.

The foregoing specification is provided for illustrative purposes only, and is not intended to describe all possible aspects of the present invention. Moreover, while the invention has been shown and described in detail with respect to several exemplary embodiments, those of ordinary skill in the art will appreciate that minor changes to the description, and various other modifications, omissions and additions may also be made without departing from the spirit or scope thereof.

The invention claimed is:

1. A method of providing a sea vessel exploration and production system used with a sub-sea well, the method comprising:

a) providing a drilling station configured to supply fluids in a drilling process from the sub-sea well, wherein the drilling station comprises at least one section of a first sea vessel hull having a moon pool formed therein, wherein the drilling station further comprises a drilling rig configured for supporting, moving and handling a self-standing riser (SSR) having a riser pipe passing through the moon pool, wherein the drilling station further comprises a void space for storing at least one buoyancy device to be positioned on the self-standing riser (SSR), the void space being configured with a gantry to transport the at least one buoyancy device towards the moon pool, and the moon pool being configured with retractable guide rails to guide the at least one buoyancy device below the hull;

b) providing a docking station configured for at least separating, treating and storing the fluids obtained from the sub-sea well in the drilling process, wherein the docking station comprises at least one section of a second sea vessel hull having production, testing and injection facilities;

c) providing a plurality of anchor lines;

d) preinstalling the plurality of anchor lines between a seabed and at least one workboat;

e) moving the docking station in the vicinity of the preinstalled anchor lines;

f) using the at least one workboat to attach at least some of the preinstalled anchor lines between the seabed and the docking station;

g) transporting and connecting the drilling station to the docking station;

h) using another workboat, attaching other of the plurality of anchor lines between the seabed and the drilling station;

i) transporting the at least one buoyancy device on the gantry for attachment to the self-standing riser (SSR);

j) guiding the self-standing riser (SSR) with the at least one buoyancy device attached thereto through the guide rails below the hull of the drilling station; and k) connecting the self-standing riser (SSR) to a wellhead on the seabed so that fluids from the sub-sea well are supplied in the drilling process on the drilling station, and then separated, treated and stored in the docking station.

2. The method of claim 1, further comprising:

l) disconnecting the drilling station from the docking station; and m) connecting a tanker with the docking station to provide for transfer of fluids between the tanker and the docking station.

3. The method of claim 1, further comprising:

n) anchoring a turret mooring buoy in the sea; and o) connecting at least one of the drilling station, the docking station and the connected drilling station and docking station to the turret mooring buoy to provide 360° rotation of the particular station or stations to which the turret mooring buoy is attached.

4. The method of claim 3, wherein the turret mooring buoy is configured for attachment to a lower end of the connected drilling station and docking station such that the self-standing riser (SSR) passes through the turret mooring buoy.

5. The method of claim 4, wherein the lower end of the connected drilling station and docking station includes a guide for receiving the turret mooring buoy.

6. The method of claim 1, wherein a mooring system connects the drilling station and the docking station in spaced apart end-to-end relationship.

7. The method of claim 6, wherein the mooring system is connected by a set of mooring lines.

8. The method of claim 1, wherein a mooring system connects the drilling station and the docking station in spaced apart lateral relationship.

9. The method of claim 1, wherein the mooring system is formed by a set of attachment devices configured to maintain a rigid separation between the drilling station and the docking station while allowing vertical movement therebetween.

10. The method of claim 9, wherein the attachment devices are defined by hydraulically compensated cylinders for maintaining a constant lateral distance between the drilling station and the docking station.

11. The method of claim 9, wherein a turret mooring buoy is provided on the drilling station when the drilling station is connected to the docking station by the attachment devices.

12. The method of claim 1, wherein the void space is further configured with a moveable floor and tracks.

13. The method of claim 1, wherein the drilling rig includes a hoisting system for raising and lowering the self-standing riser (SSR).

14. The method of claim 1, wherein the docking station includes a flare boom configured to bleed off fluid pressure.

15. The method of claim 1, wherein the facilities of the docking station are configured to inject water and gas back into the sub-sea well.

16. The method of claim 6, wherein a blast shield is positioned between the mooring system and the production, testing and injection facilities on the docking station.

* * * * *